US008120542B2

(12) United States Patent
Shoji

(10) Patent No.: US 8,120,542 B2
(45) Date of Patent: Feb. 21, 2012

(54) NOTCH ANTENNA AND WIRELESS DEVICE

(75) Inventor: Hideaki Shoji, Chiba (JP)

(73) Assignee: Sony Ericsson Mobile Communications AB, Lund (SE)

( * ) Notice: Subject to any disclaimer, the term of this patent is extended or adjusted under 35 U.S.C. 154(b) by 365 days.

(21) Appl. No.: 12/541,355

(22) Filed: Aug. 14, 2009

(65) Prior Publication Data

US 2010/0060530 A1 Mar. 11, 2010

(30) Foreign Application Priority Data

Sep. 5, 2008 (JP) ..... 2008-228002

(51) Int. Cl.
*H01Q 13/10* (2006.01)

(52) U.S. Cl. ..... 343/767; 343/700 MS; 343/702

(58) Field of Classification Search ..... 343/700 MS, 343/702, 767, 770, 829, 846
See application file for complete search history.

(56) References Cited

U.S. PATENT DOCUMENTS

| | | | | |
|---|---|---|---|---|
| 4,130,822 | A * | 12/1978 | Conroy | 343/700 MS |
| 5,068,670 | A * | 11/1991 | Maoz | 343/767 |
| 5,451,966 | A * | 9/1995 | Du et al. | 343/715 |
| 6,664,931 | B1 * | 12/2003 | Nguyen et al. | 343/767 |
| 7,187,338 | B2 * | 3/2007 | Boyle et al. | 343/770 |
| 7,589,687 | B2 * | 9/2009 | Iwai et al. | 343/767 |

FOREIGN PATENT DOCUMENTS

| | | |
|---|---|---|
| JP | 5-110332 | 4/1992 |
| JP | 2000-36721 | 2/2000 |
| JP | 2004-32303 | 1/2004 |
| JP | 2004-274445 | 9/2004 |
| JP | 2004-336328 | 11/2004 |
| JP | 3844717 | 8/2006 |
| JP | 3916068 | 2/2007 |
| WO | WO 2006/097496 A1 | 9/2006 |
| WO | WO 2007/023442 A2 | 3/2007 |
| WO | WO 2007/023442 A3 | 3/2007 |

* cited by examiner

*Primary Examiner* — Tho G Phan
(74) *Attorney, Agent, or Firm* — Oblon, Spivak, McClelland, Maier & Neustadt, L.L.P.

(57) ABSTRACT

A notch antenna includes a ground conductor having a slit and a reactance circuit containing a capacitive reactance element and an inductive reactance element, the reactance circuit being placed at an open end of the slit so as to bridge the slit and being connected to the ground conductor. The slit has a closed end to which power is supplied, and the capacitance of the capacitive reactance element and the inductance of the inductive reactance element are set so that the reactance circuit has a capacitance desired to obtain a first antenna resonance point at a first frequency and a capacitance desired to obtain a second antenna resonance point at a second frequency.

11 Claims, 12 Drawing Sheets

100
12
14
16
18
19
B
B=1.5 mm
11.00
10.00
9.000
8.000
7.000
6.000
5.000
4.000
3.000
2.000
1.000

NOTCH ANTENNA AND WIRELESS DEVICE

BACKGROUND OF THE INVENTION

1. Field of the Invention

The present invention relates to notch antennas having multiple resonant frequency bands and wireless devices using the same.

2. Description of the Related Art

With the current trend toward multifunctional mobile wireless terminals, various functions, such as GPS (Global Positioning System) and Bluetooth™ (a short range radio communication system), are implemented in mobile wireless terminals. In addition, mobile wireless terminals each incorporating a plurality of wireless communication systems using different frequency bands, or what is called multiband mobile wireless terminals, have been developed and have appeared on the market.

From the viewpoint of downsizing and weight reduction of wireless terminals each employing a plurality of wireless communication systems, it is preferable to share a built-in antenna among the plurality of wireless communication systems.

Japanese Patent No. 3916068 discloses a notch antenna provided by forming a notch (or a slit), which is a slim groove having an open end, in a ground plate (ground conductor). The notch antenna is relatively simple in structure and therefore suitable as an antenna device built in a mobile or small wireless device.

The resonant frequency of a notch antenna is determined by the length of the slit, and the length is usually set to approximately 0.2 times the wavelength of a working frequency. For working frequency bands used by PDC (Personal Digital Cellular) systems (approximately 800 MHz) or GSM (Global System for Mobile communications) systems (approximately 800 to 900 MHz) in the past, the slit is usually set as long as 70 to 80 mm, and it is not easy to incorporate such a long-slit notch antenna in mobile phone terminals supporting these systems. On the other hand, the notch antennas can be easily adapted to third generation mobile phone systems (e.g., W-CDMA system operating at approximately 2 GHz), GPS-installed mobile phone terminals (approximately 1.575 MHz) and systems operating in higher frequency bands, such as Bluetooth (2.5 GHz).

Proposed in Japanese Patent No. 3844717 and Japanese Unexamined Patent Application Publication No. 2004-274445 are notch antennas in which a plurality of slits are formed in a ground plate to obtain multiband operation.

Japanese Unexamined Patent Application Publication No. 2004-32303 proposes a technique of producing resonance in a plurality of frequency bands by providing a resonator on a short-circuited end (closed end) side of a slit of a notch antenna to make the slit behave as if it is short at high frequencies.

Moreover, Japanese Unexamined Patent Application Publication No. 2004-336328 proposes a technique of obtaining broadband characteristics (double resonance characteristics) by inserting a parallel resonant circuit in the vicinity of a closed end of a slit in parallel, the parallel resonant circuit including a capacitor arranged in parallel with inductance occurring between the feed point and short-circuited end.

SUMMARY OF THE INVENTION

The formation of a plurality of notches, as disclosed in Japanese Patent No. 3844717 and Japanese Unexamined Patent Application Publication No. 2004-274445, prevents miniaturization of the notch antenna.

The related art, disclosed in Japanese Unexamined Patent Application Publication No. 2004-32303, makes the electrical slit-length short in high frequencies; however, the shorter slit-length lowers the efficiency of the antenna. The related art, therefore, may not make full use of the physical size of the entire notch, in other words, it may not obtain antenna efficiency proportional to the size of the antenna.

Since the Q factor inherent in the parallel resonant circuit determines the interval between the two resonant frequencies and the inductance value is not adjustable in the related art disclosed in Japanese Unexamined Patent Application Publication No. 2004-336328, the bandwidths of the resonant frequencies become narrower with the increase in the interval between the frequencies. To prevent this, a limit is necessarily imposed on the interval between the two frequencies. In addition, the capacitor placed in the vicinity of the closed end of the slit also increases the match loss caused by the resistance component of the capacitor, thereby impairing the antenna efficiency.

Against these backdrops, an embodiment of the present invention provides a relatively simple-structured one-slit notch antenna capable of producing resonance in a plurality of frequency bands, and a wireless device using the notch antenna.

The notch antenna according to the embodiment of the present invention includes a ground conductor having a slit and a reactance circuit containing a capacitive reactance element and an inductive reactance element, the reactance circuit being placed at an open end of the slit so as to bridge the slit and being connected to the ground conductor. The slit has a closed end to which power is supplied. The capacitance of the capacitive reactance element and the inductance of the inductive reactance element are set so that the reactance circuit has a capacitance desired to obtain a first antenna resonance point at a first frequency and a capacitance desired to obtain a second antenna resonance point at a second frequency.

Since the reactance circuit presenting capacitive reactance in at least two frequency bands is placed at the open end of the slit so as to bridge the slit and is connected to the ground conductor, the notch antenna can operate as a capacity loaded antenna in the plurality of bands, and obtain multi-resonance characteristics.

The wireless device according to the embodiment of the present invention includes a notch antenna and a feeding unit that supplies power to the notch antenna. The notch antenna includes a ground conductor having a slit and a reactance circuit containing a capacitive reactance element and an inductive reactance element, the reactance circuit being placed at an open end of the slit so as to bridge the slit and being connected to the ground conductor. The slit has a closed end to which power is supplied. The capacitance of the capacitive reactance element and the inductance of the inductive reactance element are set so that the reactance circuit has a capacitance desired to obtain a first antenna resonance point at a first frequency and a capacitance desired to obtain a second antenna resonance point at a second frequency.

DESCRIPTION OF THE PREFERRED EMBODIMENTS

With reference to the drawings, a preferred embodiment of the present invention will be described in detail below.

Figure 1A:
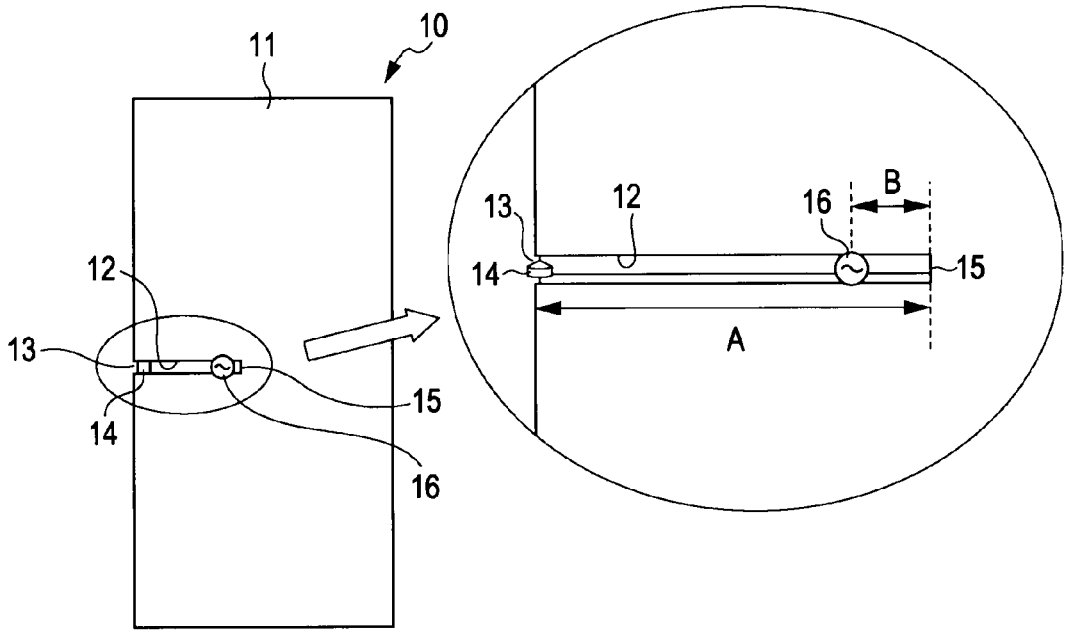
FIGS. 1A and 1B are illustrations of a notch antenna according to an embodiment of the present invention, FIG. 1A showing the configuration of the notch antenna and FIG. 1B being a graph showing the resonance characteristics.
Figure 1B:
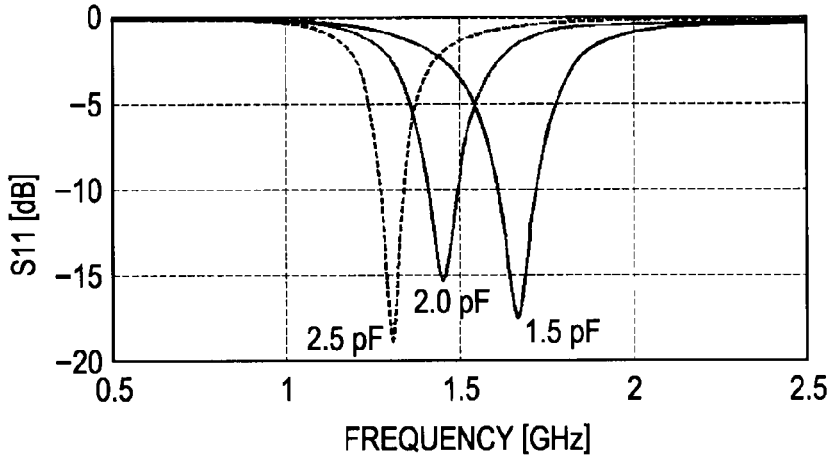

FIGS. 1A and 1B are illustrations of a notch antenna according to an embodiment of the present invention. FIG. 1A illustrates the configuration of the notch antenna, while FIG. 1B is a graph showing the resonance characteristics of the notch antenna. The horizontal axis of the graph in FIG. 1B represents frequency and the vertical axis represents return loss (reflection coefficient: S11 of S-parameters).

As shown in FIG. 1A, a notch antenna 10 is made up of a ground plate (ground conductor) 11 with a notch or slit 12 formed in the ground plate 11, the slit 12 being a slim groove having a short-circuited end 15, and a feed point 16 placed in the vicinity of the short-circuited end 15. The resonant frequency of the notch antenna 10 is determined by the length of the slit 12 (hereinafter referred to as "slit length"). The characteristic impedance of the antenna is determined by the distance B from the short-circuited end 15 of the slit 12 to the feed point 16 (the characteristic impedance is 50Ω in this description).

In addition to the above components the notch antenna is provided with a capacitor 14 bridging the slit at an open end 13 as shown in FIG. 1A. Replacement of the capacitor with a capacitor having a different capacitance enables adjustment of the resonant frequency of the notch antenna without changing its physical shape (especially, the slit length) as shown in FIG. 1B.

In the example in FIGS. 1A and 1B, the ground plate 11 has a size of 80 mm×40 mm, a thickness of 1 mm, a slit length A of 15 mm, and a slit width of 1 mm, and the distance B is 4 mm; however, these concrete values are merely examples and the present invention is not limited to these specific values.

Figure 2A:
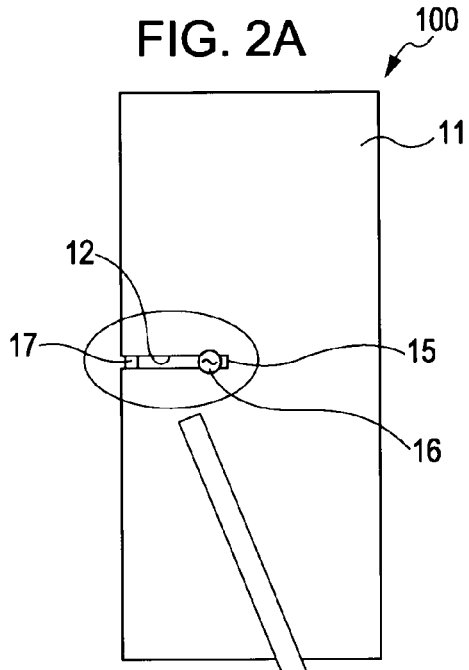
FIGS. 2A, 2B and 2C are illustrations showing a schematic configuration of a notch antenna according to another embodiment of the present invention.
Figure 2B:
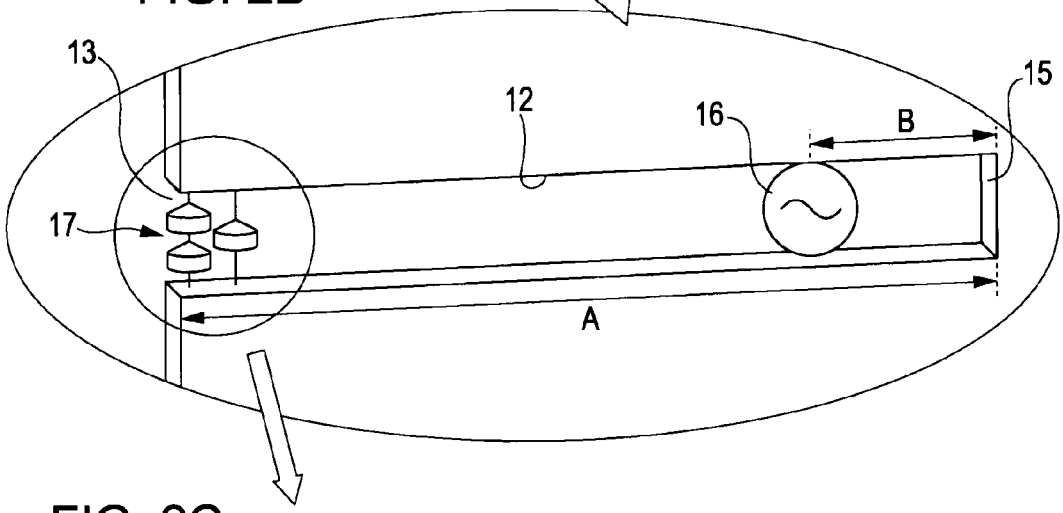
Figure 2C:
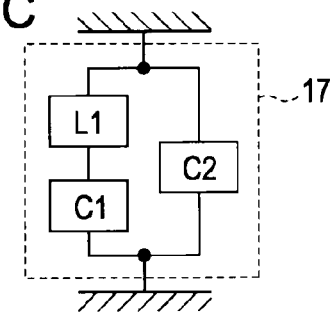

FIGS. 2A to 2C illustrate schematic configurations of a notch antenna 100 according to another embodiment of the present invention. The feed point 16 is placed on the side of the closed end of the slit 12 formed in the ground conductor 11. As shown in FIGS. 2A and 2B, the capacitor 14 placed at the open end 13 of the slit is replaced with a reactance circuit 17. This reactance circuit 17 is an LC resonant circuit, including an inductor (inductive reactance element) L and capacitors (capacitive reactance elements) C, whose capacitance varies in accordance with frequencies (frequency L and frequency H). For these elements, small components, such as chip parts (surface-mount devices) can be used. Although the elements are shown as being leaded components in FIG. 2B, the form of the parts making up each element is not limited in the present invention. The capacitance of each capacitive reactance element and the inductance of the inductive reactance element are set so that the reactance circuit 17 has a capacitance desired to obtain a first antenna resonance point at a first frequency and a capacitance desired to obtain a second antenna resonance point at a second frequency.

In the embodiment, the slit length A is 21 mm, slit width is 1 mm, impedance matching is 50Ω, and the distance B is 4 mm. The configuration allows the notch antenna to produce resonance in a plurality of frequency bands without replacing the element placed at the open end 13 of the slit. Since electric field strength changes most at the open end 13 of the slit, it is preferable to arrange the reactance circuit 17 in the vicinity of the open end 13 of the slit. In this embodiment, the reactance circuit 17 is placed approximately 2 to 3 mm inward from the open end 13.

FIG. 2C illustrates an exemplary reactance circuit 17. This reactance circuit 17 includes a series circuit with an inductor L1 and a first capacitor C1 connected to each other in series and a second capacitor C2 connected to the series circuit in parallel. The reactance circuit 17, which has capacitive reactance, serves as a dual-band matching circuit in two frequency bands (e.g., 3 pF in 800 MHz band and 1.5 pF in 2 GHz band).

Figure 3A:
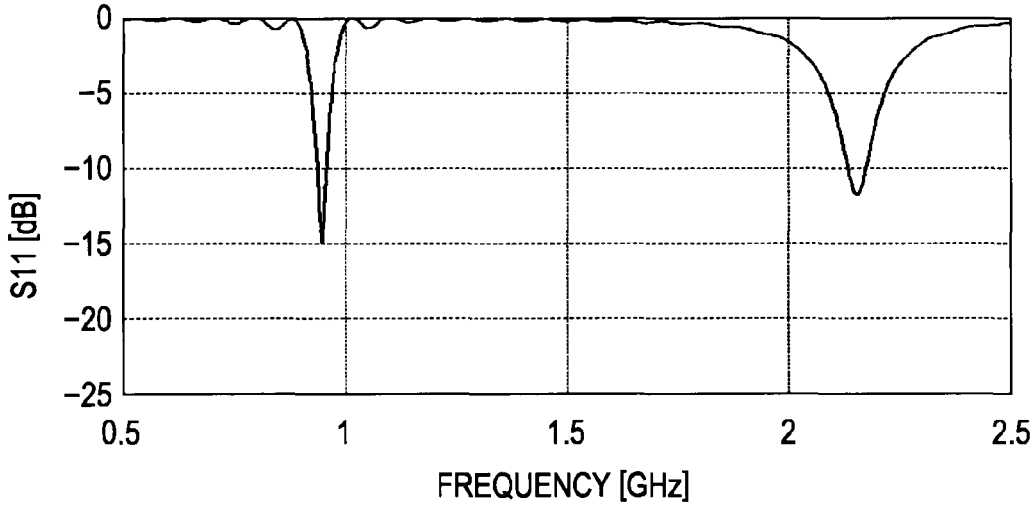
FIGS. 3A and 3B are graphs showing the relationship between frequency and return loss and the relationship between frequency and antenna efficiency of the notch antenna shown in FIGS. 2A to 2C, respectively, those results are obtained through simulation.
Figure 3B:
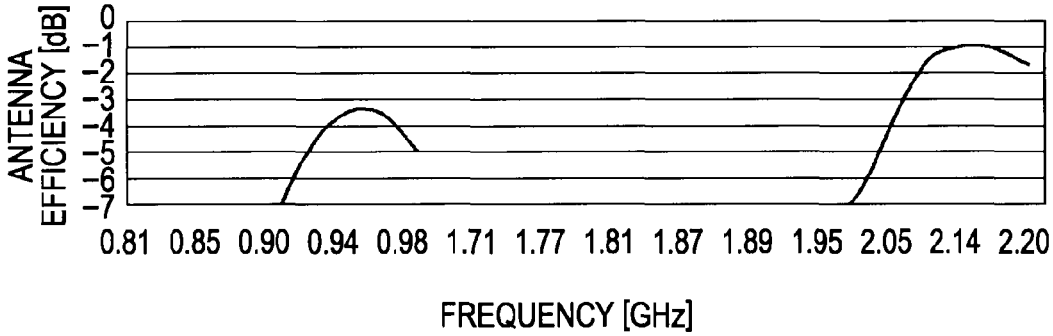

FIGS. 3A and 3B are graphs showing the relationship between frequency and return loss and between frequency and antenna efficiency of the notch antenna shown in FIGS. 2A to 2C, respectively, the data being obtained by simulation. The simulation is an electromagnetic field simulation using an FDTD (Finite Difference Time Domain) method. These graphs show that the notch antenna produces resonance in two frequency bands and offers high antenna efficiencies in each band. In both bands, two different current modes are shown, proving that the resonance is not a single resonance spread across a wide band. Note that the graph in FIG. 3B shows resonance around 950 MHz and 2.2 GHz, which do not exactly agree with the frequency bands, "3 pF in the 800 MHz band and 1.5 pF in the 2 GHz band", shown in FIGS. 2A to 2C. This is because the graphs in FIGS. 3A and 3B show computing results based on reactance including actual resistance components.

Figure 4:
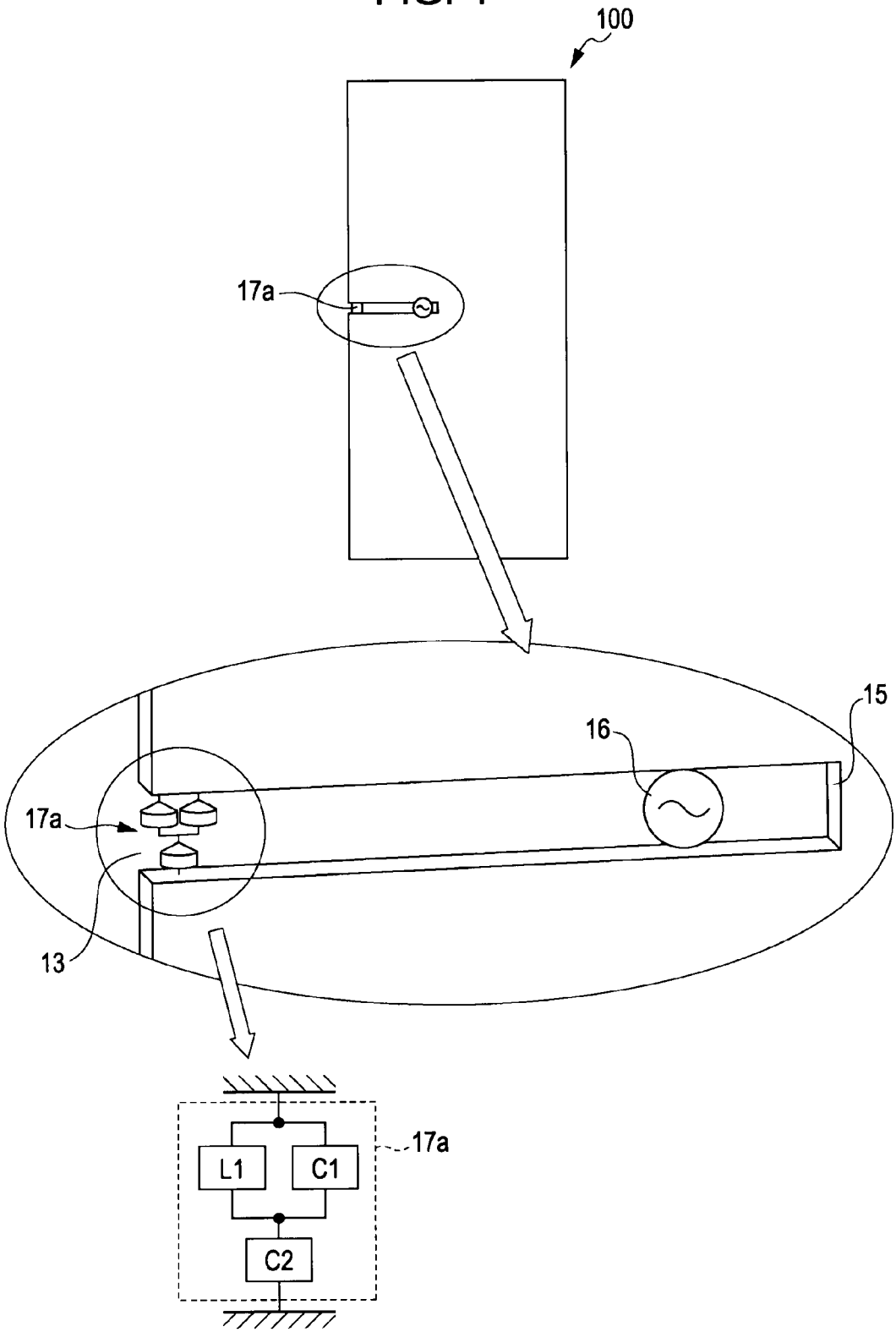
FIG. 4 illustrates a circuit diagram of another example of the reactance circuit shown in FIGS. 2A to 2C.

The configuration of the reactance circuit 17 is not limited to the one shown in FIG. 2C. For example, the reactance circuit 17*a* in FIG. 4 includes a parallel circuit with a first inductor L1 and a first capacitor C1 connected to each other in parallel and a second capacitor C2 connected to the parallel circuit in series.

Figure 5A:
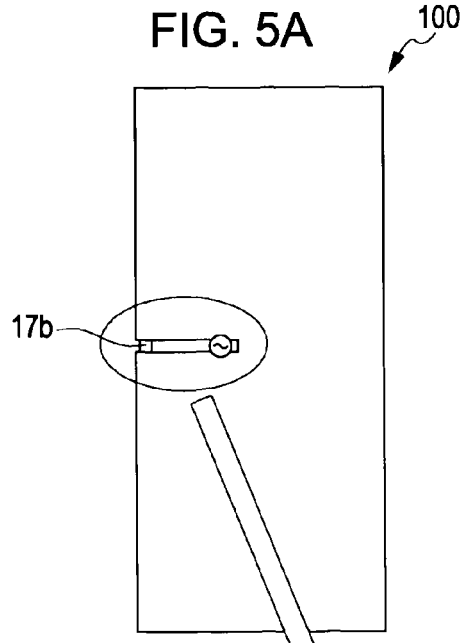
FIGS. 5A, 5B and 5C are illustrations of a modification of the notch antenna shown in FIGS. 2A to 2C.
Figure 5B:
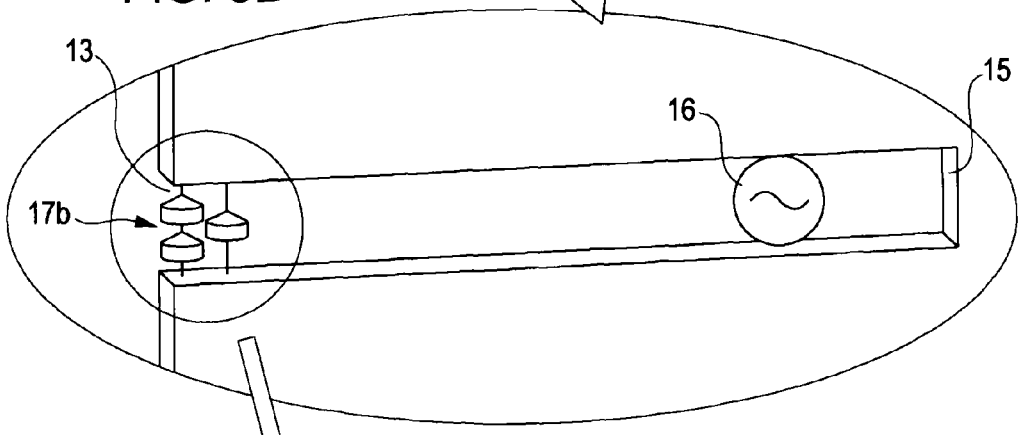
Figure 5C:
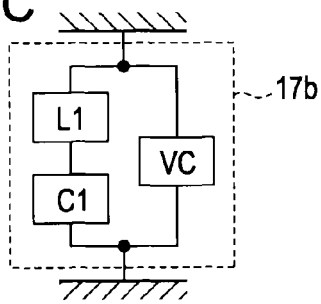

FIGS. 5A to 5C show a modification of the notch antenna shown in FIGS. 2A to 2C. Like components are denoted by like numerals of the embodiment shown in FIGS. 2A to 2C and will not be further explained. The modification in FIGS.

5A to 5C is made by replacing the capacitor C2 in the reactance circuit 17 of FIG. 2C with a variable capacitor VC, which is a capacitive reactance element whose capacitance is controllable by control signals. Controlling the capacitance in each frequency band can adaptively modulate the resonant frequency for desired bands.

Figure 6:
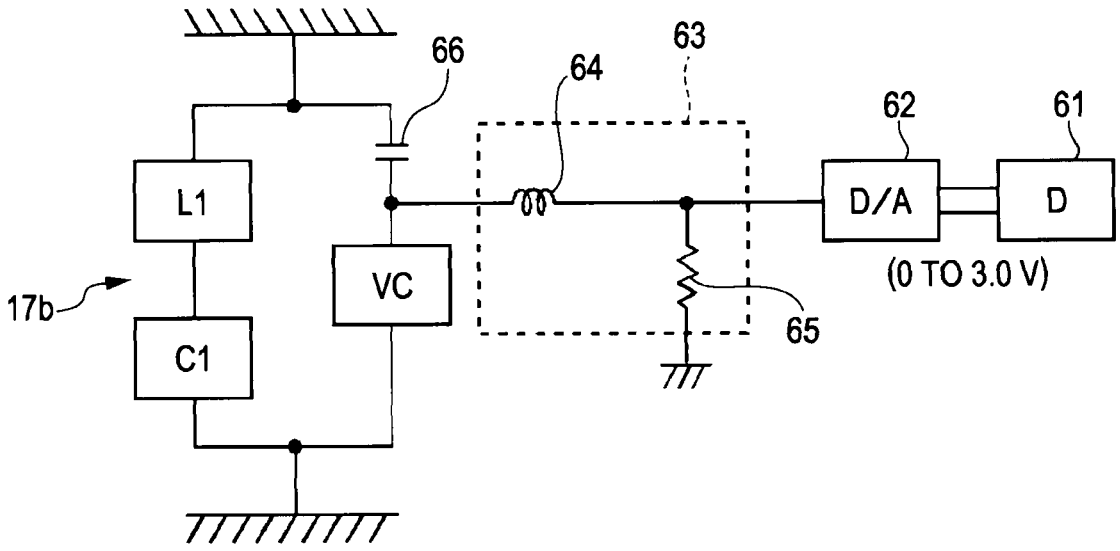
FIG. 6 illustrates an example of drive circuits for dynamically changing the capacitance of a variable capacitor VC.

FIG. 6 shows an exemplary drive circuit that can dynamically change the capacitance of the variable capacitor VC. In this example, a digital signal output from a digital circuit (D) 61, such as a processor, is converted by a digital-analog (D/A) converter 62 into an analog voltage, and then the analog voltage is applied through a bias circuit 63 to the variable capacitor VC. A capacitor 66 is interposed between the voltage-applied point and ground in order to block direct current. The bias circuit 63 includes an inductor 64 (for blocking alternating current) connected to the digital-analog converter 62 in series and a resistor 65 connected between the output of the digital-analog converter 62 and ground. In practical implementation to mobile phone terminals, the amount of bias voltage for the variable capacitor VC is preferably set to change within a range approximately from 0 to 3.0 V.

With this drive circuit, the capacitance of the variable capacitor VC can be dynamically and variably controlled.

Figure 7:
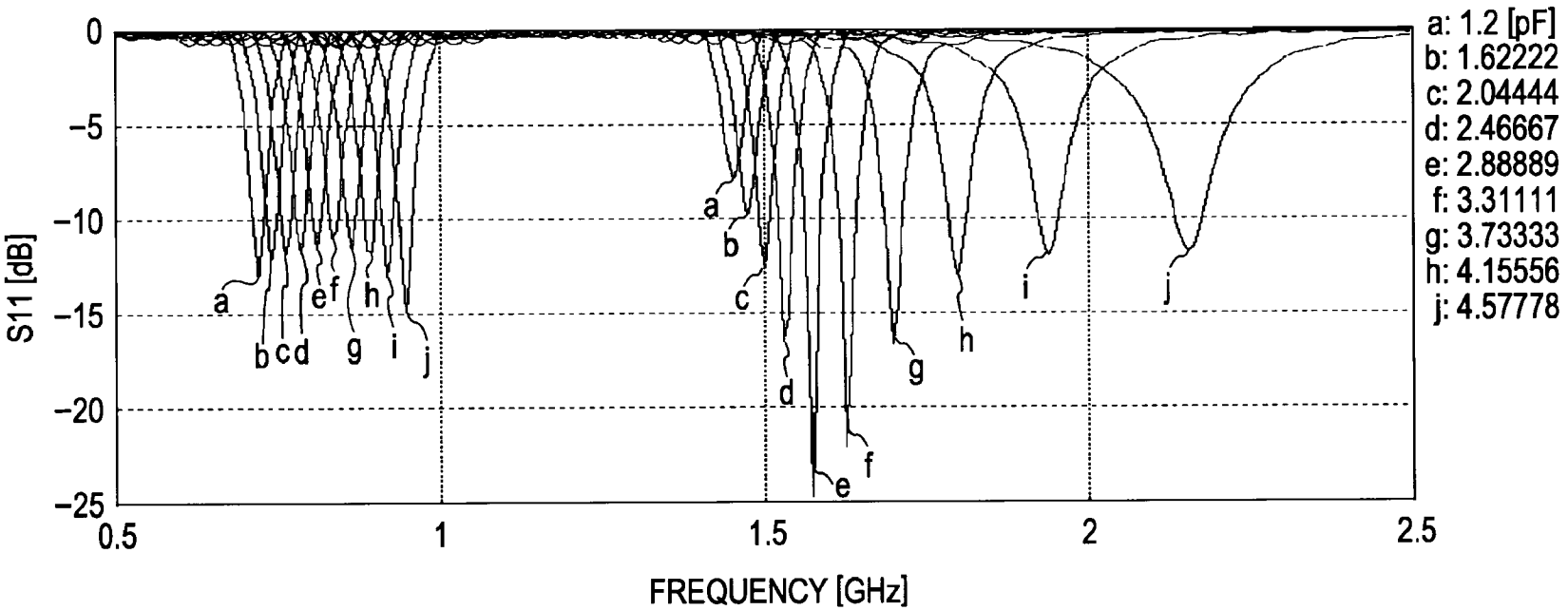
FIG. 7 is a graph showing frequency responses, obtained by simulation, of notch antennas with variable capacitors VC whose capacitances are different.

FIG. 7 is a graph showing the frequency responses of notch antennas with variable capacitors VC whose capacitance is different. The frequency responses are obtained by simulations. Variations of the bias voltage for the variable capacitors VC from 0 to 3 V change the capacitance from 1.2 pF to 5 pF stepwise (10 steps in the description). With the notch antenna according to the modifications, it is found that the resonant frequency can be modulated from 700 MHz to 900 MHz in a low band and from 1.5 GHz to 2.2 GHz in a high band.

This configuration can realize not only a diversity antenna available in 850 M/1.9 G/2.1 G, but also a multiband antenna available in the bands for GPS, Bluetooth and other systems through the use of a single antenna device.

Furthermore, with this configuration, the capacitance of the variable capacitor VC and also the resonant frequency of the notch antenna can be adjusted to adapt to certain cases. The certain cases include, for example, a case where the default resonant frequency is shifted in accordance with specific communication systems, a case of a frequency drift caused by the human body, a case of a frequency drift in a flip-style terminal caused by a user opening the terminal, and some other cases. To deal with these cases, a predetermined sensor is designed to detect whether the user interferes with the antenna part.

Figures 8A, 8B, 8C:
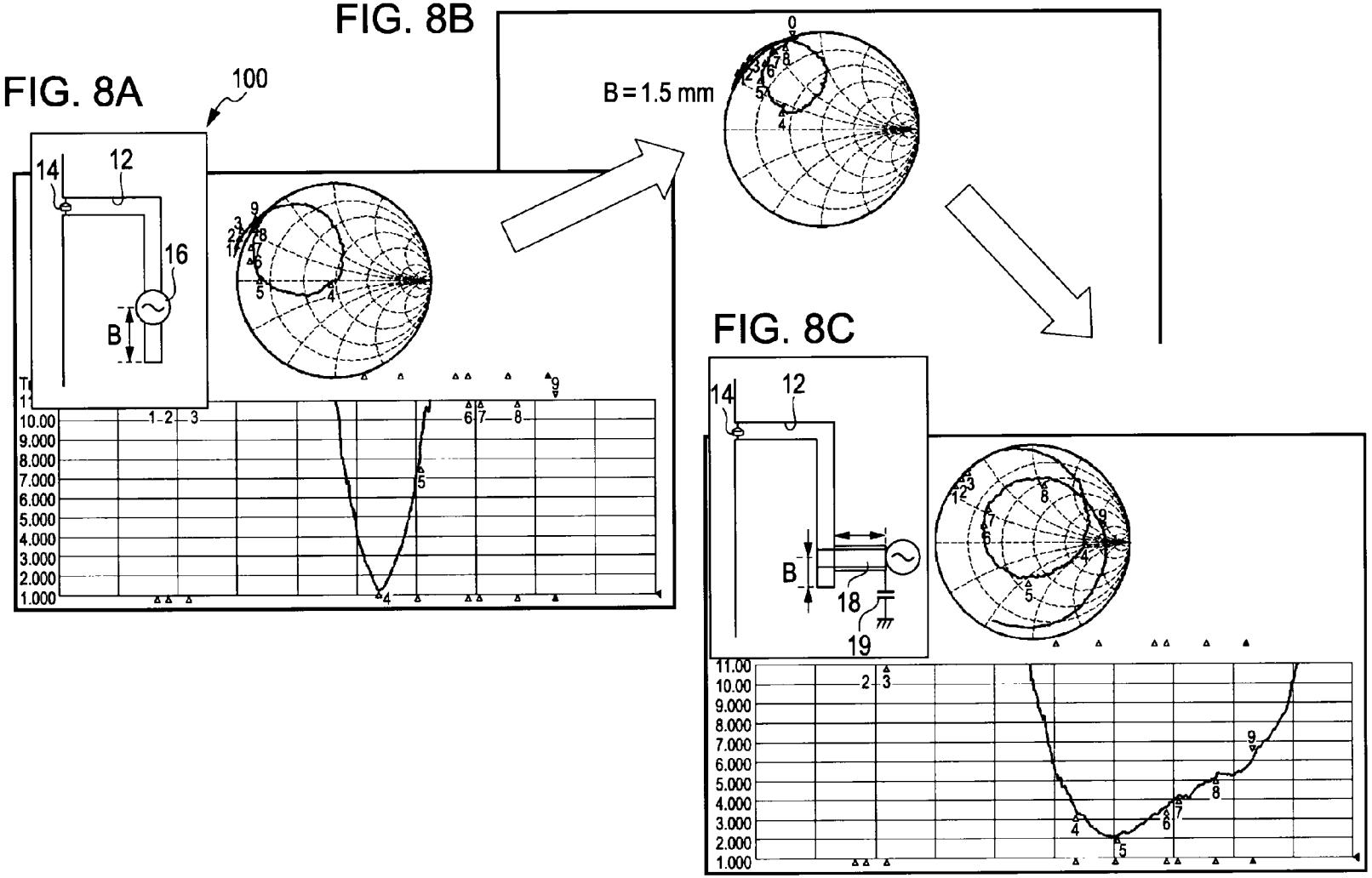
FIGS. 8A, 8B and 8C illustrate yet another embodiment of the present invention.

FIGS. 8A to 8C are illustrations showing yet another embodiment of the present invention. An existing technique is made by combining a transmission line, or stripline 18, having a characteristic impedance (50Ω in this example) matching with the characteristic impedance of the notch antenna and a capacitor 19 to move a feed point, thereby allowing the notch antenna to operate in a wider band. The notch antenna in FIG. 8A has components that are substantially the same as those of the notch antenna in FIG. 1A. Although the notch antennas in FIGS. 8A and 8C have a slit bent at some midpoint, they are in principle the same as a notch antenna having a straight slit. In other words, the slit is bendable to meet the layout constraints and requirements. In the notch antenna in FIG. 8C, an end of a stripline 18 having a predetermined length (approximately 3 mm in this example) is connected to the slit in the vicinity of the closed end of the slit, the distance from the closed end to the feed point being shorter than the above-described predetermined distance (approximately 1.5 mm from the closed end in this example). The other end of the stripline 18 is grounded via a capacitor 19 and is supplied with power.

The notch antenna in FIG. 8A exhibits impedance characteristics and frequency responses represented by a VSWR (Voltage Standing Wave Ratio) as shown in FIG. 8A. The VSWR is an index representing a ratio of reflected-to-input waves, and although being expressed in a different unit, it can be mutually converted into the above-described S11. The graph in FIG. 8A indicates that the antenna produces resonance in a single frequency band.

In the notch antenna with the configuration in FIG. 8A, at first, the feed point is displaced. Specifically, in this example, the distance B is changed from 3.5 mm to 1.5 mm. This change shifts the locus of the impedance of the antenna toward +j as shown in the Smith chart in FIG. 8B, and therefore the antenna impedance is no longer matched to 50Ω. From this configuration, the feed point is further moved along with a stripline 18 and the end of the stripline 18 adjacent to the feed point is grounded via a capacitor 19. As shown in FIG. 8C, the locus created on the Smith chart for representing impedance characteristics has a large loop so as to surround the center of the Smith chart. This allows the antenna to obtain a matched impedance of 50Ω again. As can be seen from the graph of frequency response, the single resonant frequency band is widened.

Figure 9A:
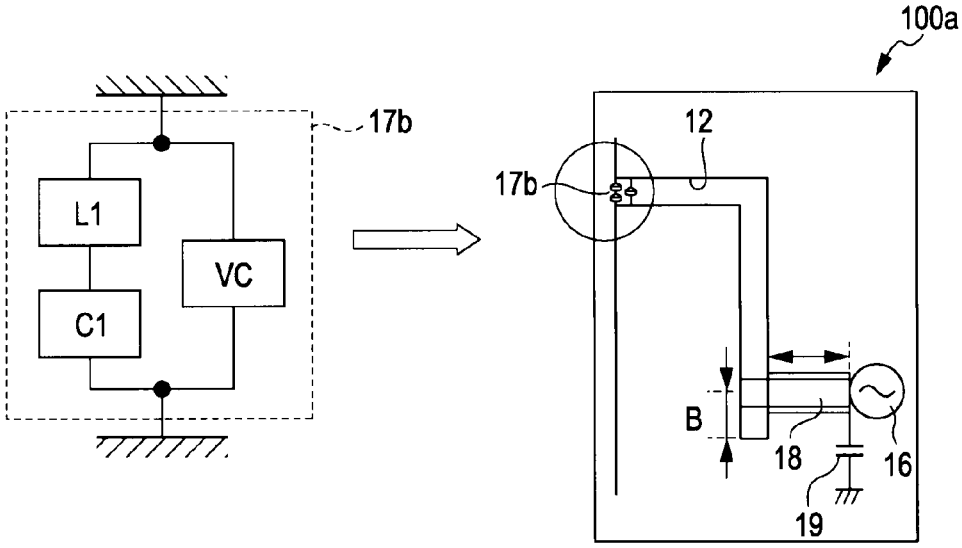
FIGS. 9A and 9B illustrate an exemplary configuration of the second modification according to the embodiment of the present invention.
Figure 9B:
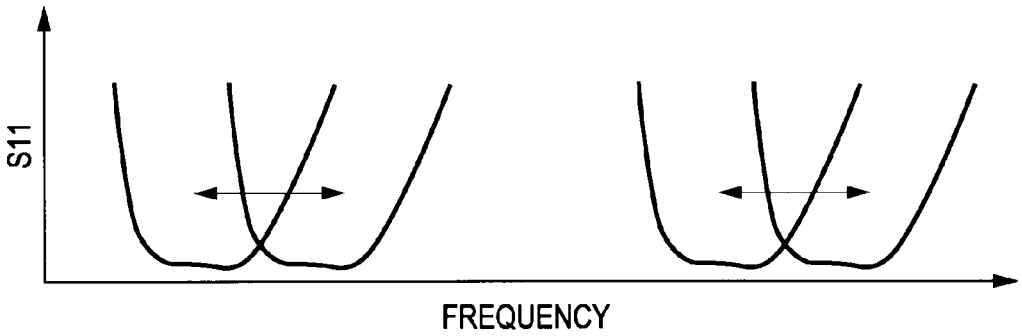

On the contrary to the embodiment in FIGS. 8A and 8B, the notch antenna 100*a* according to the second modification has a reactance circuit 17*b*, as shown in FIG. 9A, instead of the capacitor 14, and can make the resonant frequency bands wider as well as variably controlling the resonant frequencies. In short, the second modification can produce resonance in a plurality of broad frequency bands. The technique in FIGS. 8A to 8C can of course use not only the reactance circuit 17*b* but also the reactance circuit 17 or 17*a*. The antenna with the reactance circuit 17 or 17*a* does not control the resonant frequency, but can make the resonant frequency bands wider.

Next, the third modification of the embodiment of the present invention will be described.

Figure 10:
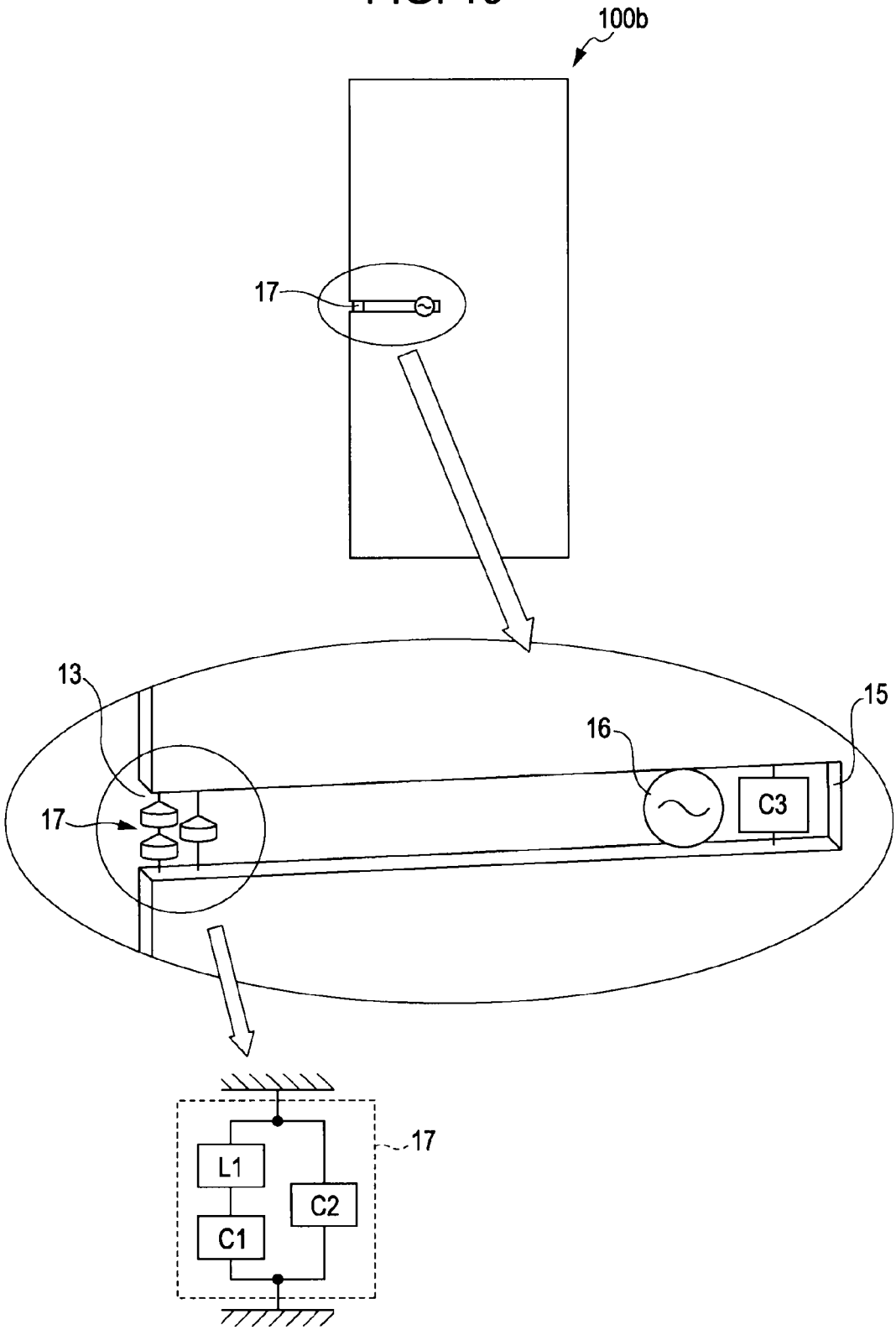
FIG. 10 illustrates the configuration of a notch antenna which is a combination of the techniques featured in Japanese Unexamined Patent Application Publication No. 2004-336328 and the techniques featured in the embodiment of the present invention.

FIG. 10 is an illustration showing the configuration of a notch antenna formed using the techniques featured in the above embodiment and the techniques featured in Japanese Unexamined Patent Application Publication No. 2004-336328. Specifically, a parallel resonant circuit is placed in the vicinity of the closed end 15 of the slit in parallel, the parallel resonant circuit including a capacitor C3 arranged in parallel with inductance occurring around the slit between the feed point 16 and short-circuited end 15. This inductance is associated with the actual circuit, but is not caused by an external device.

Figure 11:
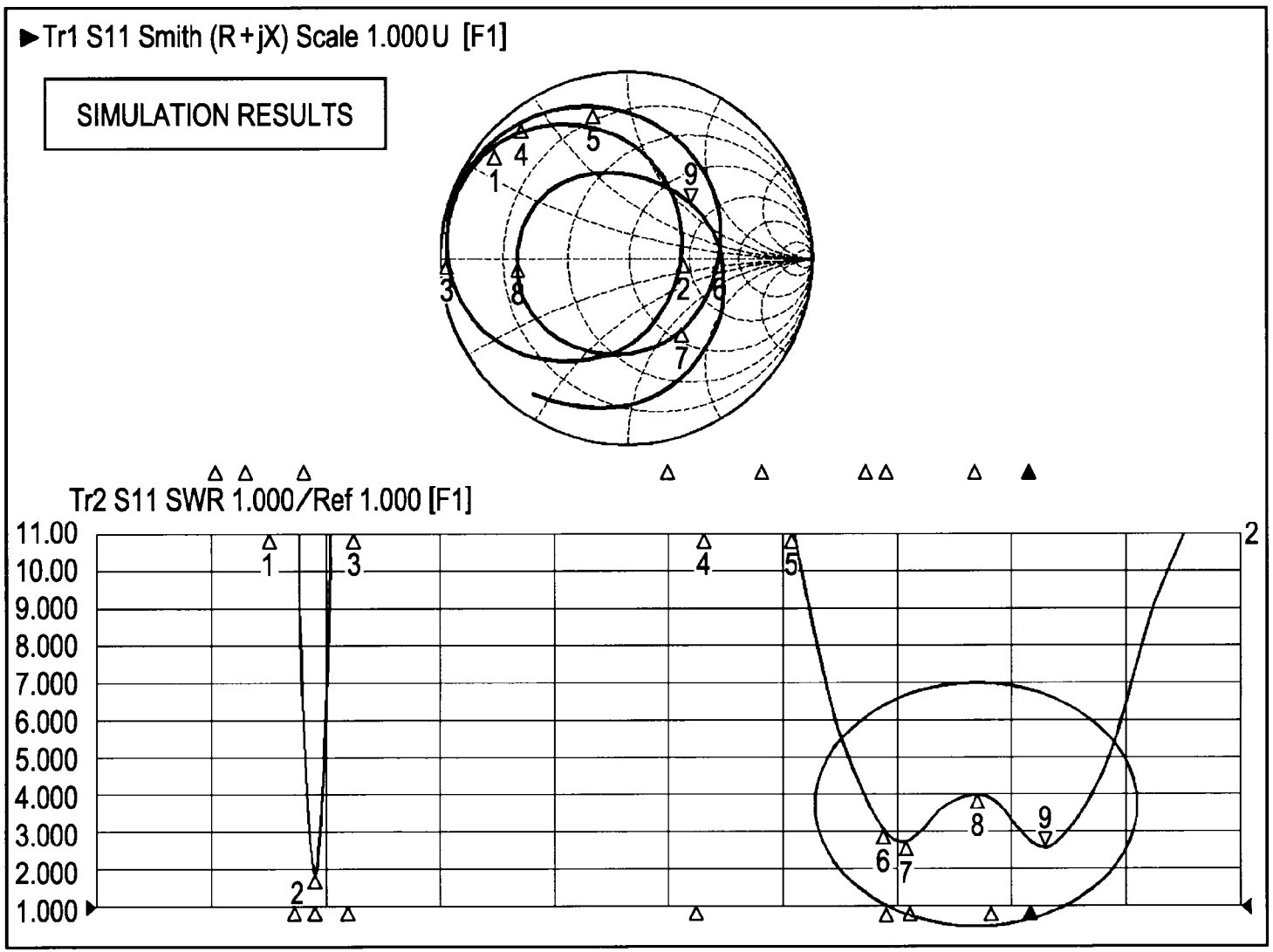
FIG. 11 depicts graphs each showing impedance characteristics and frequency response of the notch antenna shown in FIG. 10.

The notch antenna 100*b* in FIG. 10 exhibits impedance characteristics and frequency responses as shown in FIG. 11. In the Smith chart in FIG. 11, an impedance locus revolves three times around the center of the plot in accordance with changes in frequency. In addition, the graph for the frequency response shows clearly that the antenna produces resonance in the 800 MHz band and 2 GHz band, and furthermore that the resonance in the 2 GHz band is made wide (double resonance). According to the third modification, the antenna obtains frequency response with three resonances in total.

It is also possible to replace the reactance circuit 17 in FIG. 10 with a reactance circuit 17*a* or 17*b*.

Figure 12:
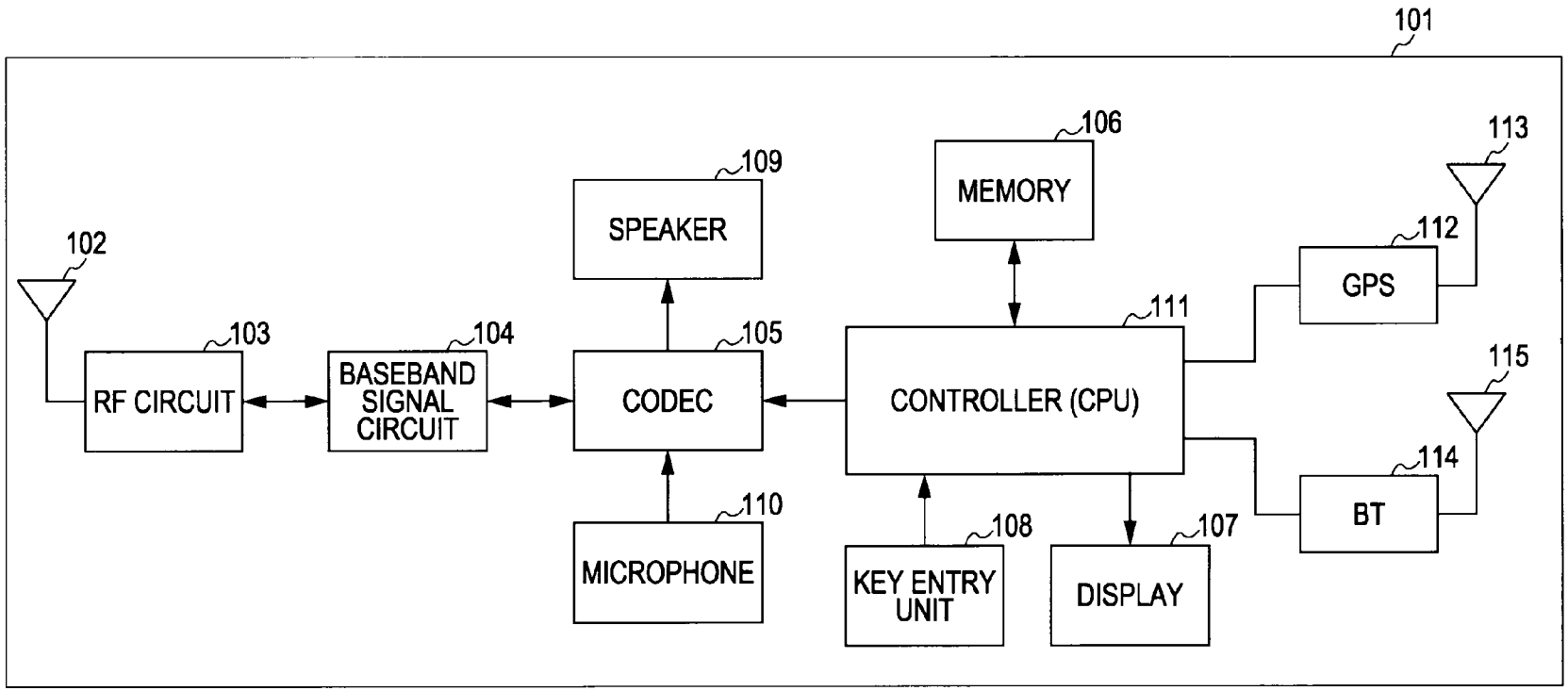
FIG. 12 is a block diagram showing a schematic hardware configuration of a mobile phone terminal to which the notch antenna according to the embodiment of the present invention can be applied.

FIG. 12 is a block diagram showing a schematic hardware configuration of a mobile phone terminal in which the notch antenna according to the embodiments of the present invention can be implemented.

A mobile phone terminal 101 includes an antenna 102, a radio-frequency circuit, or an RF circuit 103, a baseband signal circuit 104, a CODEC 105, a memory 106, a display 107, a key entry unit 108, a speaker 109, a microphone 110, a GPS circuit 112, a Bluetooth (BT) circuit 114, and a controller (CPU) 111 controlling these components. The RF circuit 103, GPS circuit 112, BT circuit 114 are provided with antennas 102, 113 and 115, respectively. In this embodiment, at least two of these antennas 102, 113, 115 can be any of the above-described notch antennas.

The CODEC 105 encodes a voice signal input through the microphone 110 to transmit it to the baseband signal circuit 104, while decoding a signal received from the baseband signal circuit 104 into a voice signal to send it to the speaker 109.

The baseband signal circuit 104 modulates the signal received from the CODEC 105 into a baseband signal to transmit it to the RF circuit 103, while retrieving a signal, which is processable by the CODEC 105, from the baseband signals decoded by the RF circuit 103.

The RF circuit 103 appropriately modulates the baseband signal received from the baseband signal circuit 104 into an RF signal (radio frequency signal) to supply it to the antenna 102, while decoding the RF signal received through the antenna 102 into a baseband signal to send it to the baseband signal circuit 104.

The memory 106 may be, for example, a ROM (Read Only Memory), a RAM, a flash memory or the like, and stores programs to be executed by the controller 111 and various setting data.

The display 107 may be, for example, a liquid crystal display for displaying various types of information.

The key entry unit 108 includes input means, such as a numeric-key pad, used by a user to input instructions and information into the controller 111.

The speaker 109 is used to output sound corresponding to the voice signals sent from the CODEC 105. On the other hand, the microphone 110 captures sound, converts it into a voice signal and then sends it to the CODEC 105.

The notch antenna according to the embodiments of the present invention can produce a plurality of resonance points with a single slit, while maintaining the existing advantages including small size and thinness. The components to be added to the antenna are only passive components, which can reduce the cost. In addition, the notch antenna produces resonance in a plurality of frequency bands by sharing the physical length of the single slit, thereby achieving high antenna efficiency.

The present application contains subject matter related to that disclosed in Japanese Priority Patent Application JP 2008-228002 filed in the Japan Patent Office on Sep. 5, 2008, the entire content of which is hereby incorporated by reference.

It should be understood that in addition to the above-described modifications, various modifications and alterations can be made to the preferred embodiments of the present invention. For instance, the present invention includes not only the aforementioned embodiments and the plurality of modifications thereof but also any possible combination of the modifications.

What is claimed is:

1. A notch antenna comprising:

a ground conductor including a slit; and a reactance circuit including a capacitive reactance element and an inductive reactance element, the reactance circuit being placed at an open end of the slit so as to bridge the slit and being connected to the ground conductor, wherein the slit has a closed end to which power is supplied, and the capacitance of the capacitive reactance element and the inductance of the inductive reactance element are set so that the reactance circuit has a capacitance desired to obtain a first antenna resonance point at a first frequency and a capacitance desired to obtain a second antenna resonance point at a second frequency.

2. The notch antenna according to claim 1, wherein the reactance circuit includes a series circuit formed of an inductive reactance element and a first capacitive reactance element and a second capacitive reactance element connected to the series circuit in parallel.

3. The notch antenna according to claim 1, wherein the reactance circuit includes a parallel circuit formed of an inductive reactance element and a first capacitive reactance element and a second capacitive reactance element connected to the parallel circuit in series.

4. The notch antenna according to claim 2 or 3, wherein the capacitive reactance element is an element whose capacitance can be controlled according to a control signal.

5. The notch antenna according to claim 4, further comprising a stripline having a predetermined length, wherein one end of the stripline is connected to the slit at a position in the vicinity of the closed end of the slit, while the other end of the stripline is grounded through another capacitive reactance element and is supplied with power.

6. The notch antenna according to claim 4, further comprising a capacitive reactance element placed in the vicinity of the closed end of the slit so as to ridge the slit, and connected to the ground conductor.

7. The notch antenna according to claim 1, wherein a feed point is positioned a predetermined distance away from and in the vicinity of the closed end of the slit.

8. The notch antenna according to any one of claims 1 to 3 or 7, further comprising a stripline having a predetermined length, wherein one end of the stripline is connected to the slit at a position in the vicinity of the closed end of the slit, while the other end of the stripline is grounded through another capacitive reactance element and is supplied with power.

9. The notch antenna according to any one of claims 1 to 3 or 7, further comprising a capacitive reactance element placed in the vicinity of the closed end of the slit so as to bridge the slit, and connected to the ground conductor.

10. A wireless device comprising:

a notch antenna; and a feeding means supplying power to the notch antenna, wherein the notch antenna includes a ground conductor including a slit and a reactance circuit including a capacitive reactance element and an inductive reactance element, the reactance circuit being placed at an open end of the slit so as to bridge the slit and being connected to the ground conductor, wherein the slit has a closed end to which power is supplied, and the capacitance of the capacitive reactance element and the inductance of the inductive reactance element are set so that the reactance circuit has a capacitance desired to obtain a first antenna resonance point at a first frequency and a capacitance desired to obtain a second antenna resonance point at a second frequency.

11. A wireless device comprising:

a notch antenna; and a feeding unit supplying power to the notch antenna, wherein the notch antenna includes a ground conductor including a slit and a reactance circuit including a capacitive reactance element and an inductive reactance element, the reactance circuit being placed at an open end of the slit so as to bridge the slit and being connected to the ground conductor, wherein the slit has a closed end to which power is supplied, and the capacitance of the capacitive reactance element and the inductance of the inductive reactance element are set so that the reactance circuit has a capacitance desired to obtain a first antenna resonance point at a first frequency and a capacitance desired to obtain a second antenna resonance point at a second frequency.

* * * * *